US009371493B1

(12) United States Patent
Oyekan

(10) Patent No.: US 9,371,493 B1
(45) **Date of Patent: *Jun. 21, 2016**

(54) LOW COKE REFORMING

(71) Applicant: Marathon Petroleum Company LP, Findlay, OH (US)

(72) Inventor: Soni O. Oyekan, LaPlace, LA (US)

(73) Assignee: Marathon Petroleum Company LP, Findlay, OH (US)

( * ) Notice: Subject to any disclaimer, the term of this patent is extended or adjusted under 35 U.S.C. 154(b) by 293 days.

This patent is subject to a terminal disclaimer.

(21) Appl. No.: 13/682,173

(22) Filed: Nov. 20, 2012

Related U.S. Application Data

(60) Provisional application No. 61/599,987, filed on Feb. 17, 2012.

(51) Int. Cl.
*C10G 35/00* (2006.01)
*C10G 35/04* (2006.01)

(52) U.S. Cl.
CPC ..... *C10G 35/04* (2013.01)

(58) Field of Classification Search
USPC ..... 208/107–108, 113, 133–134
See application file for complete search history.

(56) References Cited

U.S. PATENT DOCUMENTS 4,332,671 A 6/1982 Boyer
4,741,819 A * 5/1988 Robinson et al. ..... 208/65
5,045,177 A 9/1991 Cooper et al.
5,053,371 A 10/1991 Williamson
5,885,439 A 3/1999 Glover
5,935,415 A 8/1999 Haizmann et al.
7,419,583 B2 9/2008 Nieskens et al.
7,637,970 B1 12/2009 Fox et al.
7,988,753 B1 8/2011 Fox et al.
2005/0139516 A1 * 6/2005 Nieskens et al. ..... 208/64
2011/0147267 A1 6/2011 Kaul et al.

OTHER PUBLICATIONS

Martino, G. (2001). Petroleum Refining Conversion Processes, vol. 3, edited by P. Leprince, Technip, 670 pgs [Office action cites chapter 4, Table 4.13 & Figure 4.47].*

* cited by examiner

*Primary Examiner* — Brian McCaig
(74) *Attorney, Agent, or Firm* — Emch, Schaffer, Schaub & Porcello Co., L.P.A.

(57) ABSTRACT

This process operates a continuous catalyst regeneration (CCR) system for reforming comprising the steps of: (a) introducing a coking additive selected from the group consisting of organo sulfur, organo nitrogen and oxygenate compounds into a hydrocarbon feedstock; (b) continuously introducing the hydrocarbon feedstock and coking additive of step (a) into a CCR reforming unit; (c) continuously introducing hydrogen into the CCR reforming unit; (d) continuously operating the CCR reforming unit to produce coke and a hydrocarbon rich, hydrocarbon stream; (e) continuously operating the CCR reforming unit to burn off excess coking additive; and (f) continuously recovering the hydrocarbon rich hydrocarbon stream.

8 Claims, 1 Drawing Sheet

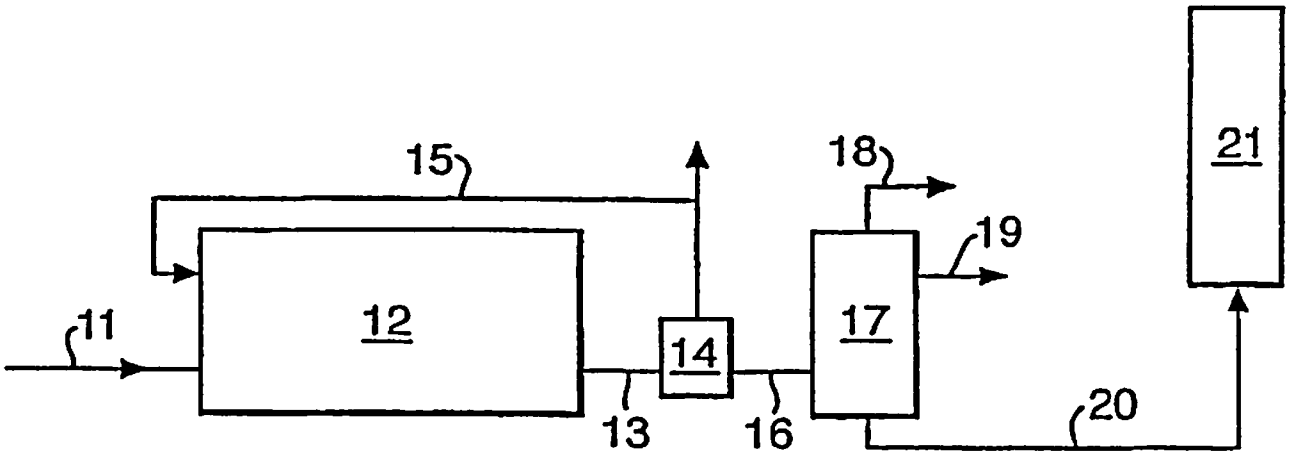
11
12
13
14
15
16
17
18
19
20
21

LOW COKE REFORMING

CROSS REFERENCE TO RELATED APPLICATION

This application is a conversion of and claims the benefit of U.S. provisional patent application Ser. No. 61/599,987 filed Feb. 17, 2012.

FIELD OF THE INVENTION

The present invention relates to continuous catalyst regeneration (CCR) reformers using materials such as sulfur compounds to enhance catalyst coke production.

BACKGROUND OF THE INVENTION

Continuous catalyst regeneration (CCR) naphtha processes are designed to operate at high severity of low pressure, low hydrogen to carbon ratio and produce high octane reformates for gasoline blending. The desired operating range to sustain steady state white burn regenerator operations for good unit productivity requires that the process generates catalyst coke in a range of 3.0 to 7.0 wt. %. Recent environmental regulations have led to a need to operate and produce low octane reformates due to substantial ethanol blending. In the past the concentration of ethanol in a gasoline blend was 10 vol. %. Recently an increase to 15 vol. % for cars manufactured after 2007 has been proposed.

Due to the need to minimize expensive gasoline octane give away, refiners are now operating their CCR reformers at low severities which lead to catalyst coke production rates that are lower than 3 wt. %. Due to considerations of catalyst flow and sustaining steady state coke burns, refiners are opting to shutting down their regenerators for long periods of time in order to not damage equipment such as air heaters, disengaging hopper and the regenerator screens. The frequent regenerator outages lead to poor catalyst performance, low unit productivity and uneconomical operative reformer operations.

SUMMARY OF THE INVENTION

This invention is a process of operating a continuous catalyst regeneration (CCR) system for reforming comprising the steps of: (a) introducing a coking additive selected from the group consisting of organo sulfur, organo nitrogen and oxygenate compounds into a hydrocarbon feedstock; (b) continuously introducing the hydrocarbon feedstock and coking additive of step (a) into a CCR reforming unit; (c) continuously introducing hydrogen into the CCR reforming unit; (d) continuously operating the CCR reforming unit to produce coke and a hydrocarbon rich, hydrocarbon stream; (e) continuously operating the CCR reforming unit to burn off excess coking additive; and (f) continuously recovering the hydrocarbon rich hydrocarbon stream.

To ensure steady state regenerator operations, this invention uses feed sulfur addition during periods of low reformer severity operations to permit building up catalyst coke rapidly. Ideally the naphtha hydrotreater severity required to sufficiently hydrotreat the naphtha feed for the reformer to remove metals, organic sulfur, and organic nitrogen and oxygenates is maintained as high as feasible. Feed sulfur can then be added to the hydrotreated naphtha to generate a reformer feed with sulfur of 0.5 to 2.0 wppm in the reformer feed.

Other objects and advantages of the present invention will become apparent to those skilled in the art upon a review of the following detailed description of the preferred embodiments and the accompanying drawings.

IN THE DRAWINGS

FIG. 1 shows a conventional CCR reforming unit.

DETAILED DESCRIPTION OF THE INVENTION

Sulfur is a known poison for naphtha reforming catalysts. This invention uses feed sulfur beneficially to enhance unit operations and productivity for CCR reformers. CCR naphtha reforming processes are quite suitable for application of the novel concept despite sulfur being known as a poison to the reformer catalyst. In CCR operations, the use of the regenerators provide a convenient means of burning off excessive sulfur that could have accumulated on the catalyst and the higher coke generated by the addition of sulfur to the naphtha feed to the reformers. The sulfur is converted to $SO_x$ and the coke ($C_xHy$) to $CO_x$ and $H_2O$. The continuous combustion of the sulfur would keep the catalyst sulfur low and not negatively impact catalyst performance. Daily catalyst coke and chloride levels permit monitoring the impact of the added sulfur and the best way to take advantage of the novel idea. More detail catalyst characterization would also provide a facile means of monitoring the level of sulfur on the catalyst.

Overall, the addition of sulfur in the 0.5 to 2.0 wppm ranges to reformer feeds would lead to a higher coke make and optimal operations of CCR reformers for profitability even during periods of low coke naphtha reforming.

FIG. 1 shows a conventional CCR reforming unit. Feedstocks are introduced via line 11 in CCR reforming unit 12. The effluent of reforming unit 12 is led via line 13 to separator 14. A hydrogen-rich gaseous stream is then separated from the effluent and partly recycled to reforming unit 12 via line 15. Further, the hydrocarbon stream is fed via line 16 to stabilizer 17. In stabilizer 17, the hydrocarbon stream is fractionated into fuel gas, a C4-hydrocarbons stream, and a C5+ reformate. The fuel gas is withdrawn via line 18, the C4-hydrocarbons stream via line 19. The reformate is sent to gasoline pool 21 via line 20.

This invention permits generating catalyst coke in the reactors so as to permit steady state white burn operations of the regenerator.

Optimizing low coke naphtha reforming processes has been a challenge for oil refiners particularly in the use of continuous catalyst regenerative (CCR) reformers for economic production of hydrogen and reformate. This novel processing scheme is for ensuring continuous regeneration of adequately coked catalyst to improve catalyst performance and reformer productivity. One of the recommended specific concepts is the intermittent use of reformer feed with sulfur content in the 0.5 to 2.9 wppm ranges and for a time to be specified to increase catalyst coke to beyond 3.0 wt %. Other variations of the concept include the use of low severity operations in the naphtha hydrotreater to permit a mix of contaminants to slip into the reformer sufficient to increase catalyst coke in the CCR reformer. Another set of variations include the use of individual contaminants in reformer feed to enhance catalyst coke production for more optimal unit production of reformate and hydrogen.

The key concept disclosed herein is the use of organo sulfur compounds to increase reformer feed sulfur to between 0.5 to 5.0 wppm as the preferred concept. More preferably, the range is 0.5 to 2.0 wppm. Application of this concept will increase catalyst coke make, enhance stability of the catalyst regenerations and improve CCR reformer performance and productivity.

The preferred sulfur range is 0.5 to 2.0 wppm feed sulfur for continuous addition. Oil refiners could extend that to 0.5 to 5.0 wppm sulfur. For the intermittent higher feed sulfur dosage of >5 wppm could lead to much higher catalyst coke >7 wt. % and the regenerator could then be operated intermittently for the purpose of attaining some degree of reactivation of the catalyst in the regenerators.

Therefore, there could be a steady state continuous low sulfur dosage of 0.2 to 2 wppm and up to 5.0 wppm for continuous steady state white burn regenerator operations. This mode will use an optimum feed sulfur level to sustain catalyst coke, at less than 6 wt. % and greater than 3 wt. %, and produce steady state regenerator operations with negligible unit performance and productivity swings.

The second approach involves intermittent dosage of higher sulfur of up to 10 wppm sulfur and this would permit building catalyst coke to over 7 wt. % rapidly. That would then require intermittent regenerator operations with non steady state performance and productivity for the reformer. The intermittent higher feed sulfur operation is also doable even though this could lead possibly to reliability and unit performance problems. That is why we are claiming a broad range of feed sulfur addition.

However, the intermittent operation of the regenerator would lead to incomplete catalyst reactivation and potential damages to catalyst and regenerator screens. In addition, excessive catalyst fines make due to catalyst damage in poorly, intermittent regenerator operations would lead to reactor screen plugging and reactor outages for screen cleaning.

To illustrate the benefits of the feed sulfur additive invention, averaged data for 2011 quarters for the period when the reformer was operating with low sulfur are shown below. The data show that even when operating with naphtha feeds with high final boiling points of about 400 degrees F. as determined by the ASTM D3710 procedure, the spent catalyst coke is in the range of 2.8 wt. % to 4.2 wt. % due to the low octane severity reforming operations.

The averaged quarterly data for 2011 (below) reflects the unsteady state nature of the regenerator and especially for white burn needed for catalyst activation. After corrections are made for octane deviations and at about 94.1 RON, the C5+ or reformate yields were in the range of 83.5 to 83.9 vol. %. In some cases, naphtha feed endpoints were also higher than 390 F and this led to desired increased coke and moderately aided the catalytic performance of the reformer.

Feed Properties for 2011 Pre High Sulfur Operations

| Date, 2012 | 1Q | 2Q | 3Q | 4Q |
|---|---|---|---|---|
| C5+ Octane, RON | 94.7 | 92.8 | 94.1 | 91.8 |
| Sulfur, wppm | 0.36 | 0.32 | 0.30 | 0.37 |
| Feed EP, F. | 408 | 408 | 408 | 400 |
| Feed N + 2A | 62.0 | 60.0 | 59.8 | 58.6 |
| Naphthenes, vol. % | 30.1 | 29 | 29.8 | 28.6 |
| Aromatic, vol. % | 16.0 | 15.5 | 15.0 | 15.0 |

Note: Naphtha feed endpoints were high at 400 F. to 408 F. in 2011

2011 Quarterly Performance Data

| | 1Q | 2Q | 3Q | 4Q |
|---|---|---|---|---|
| C5+ Octane, RON | 94.7 | 92.8 | 94.1 | 91.8 |
| C5+, vol. % | 82.9 | 85.9 | 83.7 | 86.7 |
| H2, SCF/B | 1317 | 1266 | 1176 | 1196 |
| Ref. Aromatics, vol. % | 58.9 | 56.7 | 56.8 | 55.7 |
| Catalyst Coke, wt. % | 3.5 | 2.8 | 4.2 | 3.5 |
| Coke Burning rate, pph | 37.7 | 29.9 | 49.2 | 27.8 |

Moderate feed sulfur additions as per the invention and contrary to past known sulfur contaminating experiences did not lead to degradation of productivity of a CCR reformer as shown in Examples 1 and 2.

Long term use of moderate sulfur and steady state white burn regenerator operations are expected to lead to improvements in unit productivity relative to the previous low coke, non-steady state white burn operations due to improved platinum dispersion of the catalyst and continuous catalyst reactivations. Steady state white burn regenerator operations also enhance the reliability of the regenerator and reactor screens.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

Example 1

Provides comparative data at about 92 reformate (RON) for a period with low feed sulfur (0.28 wppm) during Jan. 8-12, 2012 and that of high average feed sulfur (0.92 wppm) during Feb. 13-17, 2012. Refinery personnel varied the naphtha feed sulfur as required to control catalyst performance to meet refinery naphtha processing objectives rather than maintaining constant the high feed sulfur level.

TABLE 1

Feed Properties A Reformer Operations at 92 RON

| | Low Sulfur Run | High Sulfur run |
|---|---|---|
| Date, 2012 | Jan 8-12 | Feb 13-17 |
| C5+ Octane, RON | 92.3 | 91.5 |
| Sulfur, wppm | 0.28 | 0.92 |
| Feed N + 2A | 58.9 | 61.7 |
| Naphthenes, vol. % | 28.9 | 27.3 |
| Aromatics, vol. % | 15.0 | 17.2 |

TABLE 2

Performance Comparison at 92 RON

| | Low Sulfur Run | High Sulfur Run |
|---|---|---|
| Date, 2012 | Jan 8-12 | Feb 13-17 |
| C5+ Octane, RON | 92.3 | 91.5 |
| C5+, vol. % | 85.1 | 85.8 |
| H2, SCF/B | 1023 | 1082 |
| Reformate Aromatics, vol. % | 56.9 | 57.6 |
| Catalyst Coke, wt. % | 2.8 | 6.0 |
| Coke Burning rate, pph | 37.6 | 43.5 |

Example 2

Provides comparative data at about 97.0 RON from a period of low sulfur feed (0.30 wppm) naphtha reforming operation during Jan. 12-16, 2012 and that of high feed sulfur (0.60 wppm) during Feb. 29-Mar. 3, 2012. Refinery personnel varied the naphtha feed sulfur as required to control catalyst to meet refinery naphtha processing objectives rather than maintaining constant the high feed sulfur level.

TABLE 3

Feed Properties For Reformer at 97 RON

| | Low Sulfur Run | High Sulfur Run |
|---|---|---|
| Date, 2012 | Jan 12-16 | Feb 29-March 3 |
| C5+ Octane, RON | 96.7 | 96.9 |
| Sulfur, wppm | 0.30 | 0.60 |
| Feed N + 2A | 58.8 | 59.4 |
| Naphthenes, vol. % | 30.4 | 32.8 |
| Aromatics, vol. % | 14.2 | 13.2 |

TABLE 4

Performance Comparison at 97 RON

| | Low Sulfur Run | High Sulfur run |
|---|---|---|
| Date 2012 | Jan 12-16 | Feb 29-March 3 |
| C5+ Octane, RON | 96.7 | 96.9 |
| C5+, vol. % | 85.0 | 84.3 |
| H2, SCF/B | 1259 | 1330 |
| Reformate Aromatics, vol. % | 49.8 | 55.0 |
| Catalyst Coke, wt. % | 3.5 | 5.0 |

I claim:

1. A process of operating a continuous catalyst regeneration (CCR) reforming system comprising the steps of:

(a) introducing a measured amount of sulfur for the purpose of maintaining steady state regenerator conditions, into a hydrocarbon feedstock prior to entering a CCR reforming unit;

(b) continuously introducing the hydrocarbon feedstock and sulfur into the CCR reforming unit;

(c) continuously introducing hydrogen into the CCR reforming unit;

(d) continuously operating the CCR reforming unit to produce catalyst coke and a hydrocarbon rich, hydrocarbon stream;

(e) continuously operating the CCR reforming unit to burn off excess catalyst coke; and (f) continuously recovering the hydrocarbon rich hydrocarbon stream.

2. The process according to claim 1 wherein the hydrocarbon feedstock contains 0.5 to 10.0 wppm of sulfur.

3. The process according to claim 1 wherein the hydrocarbon feedstock contains 0.5 to 5.0 wppm of sulfur.

4. The process according to claim 1 wherein the hydrocarbon feedstock contains 0.5 to 2.0 wppm of sulfur.

5. The process according to claim 1 further comprising the step of operating the CCR reforming unit to increase coke yield greater than 3.0 weight percent.

6. The process according to claim 1 further comprising the step of separating hydrogen from the recovered hydrocarbon stream.

7. The process according to claim 6 further comprising the step of feeding a portion of the hydrogen to the CCR reforming unit.

8. The process according to claim 1 further comprising the step of fractionating the recovered hydrocarbon stream into fuel gas, a C4− hydrocarbons stream, and a C5+ reformate.

* * * * *